US007971946B2

(12) United States Patent
Uehara

(10) Patent No.: US 7,971,946 B2
(45) Date of Patent: Jul. 5, 2011

(54) PRINTER AND METHOD FOR PRINTING

(75) Inventor: Shinichi Uehara, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 819 days.

(21) Appl. No.: 12/027,351

(22) Filed: Feb. 7, 2008

(65) Prior Publication Data

US 2009/0315927 A1 Dec. 24, 2009

(30) Foreign Application Priority Data

Feb. 8, 2007 (JP) ..... 2007-029021

(51) Int. Cl.
*B41J 2/195* (2006.01)

(52) U.S. Cl. ..... 347/7; 347/85; 347/86

(58) Field of Classification Search ..... 347/85, 347/86, 7

See application file for complete search history.

(56) References Cited

U.S. PATENT DOCUMENTS 4,680,696 A * 7/1987 Ebinuma et al. ..... 347/85
6,039,442 A * 3/2000 Hagiwara et al. ..... 347/89
6,082,851 A * 7/2000 Shihoh et al. ..... 347/85
7,850,290 B2 * 12/2010 Nitta et al. ..... 347/85
2002/0024543 A1 * 2/2002 Kimura et al. ..... 347/7

FOREIGN PATENT DOCUMENTS

JP 2004-098365 4/2004

* cited by examiner

*Primary Examiner* — Ellen Kim

(74) *Attorney, Agent, or Firm* — Ditthavong Mori & Steiner, P.C.

(57) ABSTRACT

A printer includes first and second ink cartridges, a print head having first and second nozzle arrays, first and second ink supply passages having first and second valves, and a connecting passages having a third valve. The first passage connects the first cartridge to the first nozzle array. The second passage connects the second cartridge to the second nozzle array. The connecting passage connects the first and second passages at first and second connecting portions, respectively. The first valve is provided in the first passage between the first cartridge and the first connecting portion. The second valve is provided in the second passage between the second cartridge and the second connecting portion. Both the first and second valves are open and the third valve being closed in a first state. The third valve and either one of the first and second valves are open in a second state.

10 Claims, 2 Drawing Sheets

PRINTER AND METHOD FOR PRINTING

CROSS-REFERENCE TO RELATED APPLICATIONS

The present application claims priority under 35 U.S.C. §119 to Japanese Patent Application No. 2007-029021, filed Feb. 8, 2007, entitled "Printer." The contents of this application are incorporated herein by reference in their entirety.

BACKGROUND OF THE INVENTION

1. Field of the Invention

The present invention relates to a printer and a method for printing.

2. Discussion of the Background

In case of a large-scale inkjet printer or the like, printing is often conducted during hours without operator, such as at night, because it takes time to form entire image. In this case, however, if the remaining amount of ink in an ink cartridge is small, the ink may be finished up (this phenomenon will be referred to as "ink end") during the image formation so that the printing is interrupted.

The ink end during the image formation can be avoided by replacing such an ink cartridge with a new ink cartridge before printing, for example. In this case, however, there is a problem that the amount of ink to be disposed is increased because the cartridge replaced has still remaining ink.

For solving this problem, a method has been conventionally proposed in which a plurality of ink cartridges for ink of same color are used and are adapted to be automatically switched (for example, Japanese Unexamined Patent Application Publication 2004-098365 A). This arrangement enables ink of the respective ink cartridges to be sequentially finished up while preventing the ink end during image formation. The contents of JP 2004-098365 A are incorporated herein by reference in their entirety.

In the printer disclosed in JP 2004-098365 A for example, however, it is required to prepare ink supply mechanisms of which number is an integral multiple of the number of colors of inks to be used. As a result, problems of increase in apparatus size, increase in cost, and the like must arise. Accordingly, the method of automatically switching ink cartridges is hardly employed in a printer which is intended to be produced at low cost.

SUMMARY OF THE INVENTION

According to one aspect of the present invention, a printer includes first and second ink cartridges, a print head having first and second nozzle arrays, a first ink supply passage having a first valve, a second ink supply passage having a second valve, and a connecting passages having a third valve. The first ink supply passage connects the first ink cartridge to the first nozzle array, and the second ink supply passage connects the second ink cartridge to the second nozzle array. The connecting passage connects the first and second ink supply passages at first and second connecting portions, respectively. The first valve is provided in the first ink supply passage between the first ink cartridge and the first connecting portion. The second valve is provided in the second ink supply passage between the second ink cartridge and the second connecting portion. The third valve is provided in the connecting passage. While both the first and second valves are open and the third valve is closed in a first state, the third valve and either one of the first and second valves are open in a second state.

According to another aspect of the present invention, a method for printing includes connecting a first ink cartridge to a first nozzle array of a printing head via a first ink supply passage, connecting a second ink cartridge to a second nozzle array of a printing head via a second ink supply passage, and connecting the first and second ink supply passages via a connecting passage at first and second connecting portions, respectively. The method further includes providing a first valve in the first ink supply passage between the first ink cartridge and the first connecting portion, providing a second valve in the second ink supply passage between the second ink cartridge and the second connecting portion, and providing a third valve in the connecting passage. In this method, both the first and second valves are opened and the third valve is closed in a first state, and the third valve and either one of the first and second valves are opened in a second state.

According to further aspect of the present invention, a printer includes first and second ink cartridges, a print head having first and second nozzle arrays, a first ink supply passage having a first valve, a second ink supply passage having a second valve, a connecting passage having a third valve, and a valve controlling means. The first ink supply passage connects the first ink cartridge to the first nozzle array, and the second ink supply passage connects the second ink cartridge to the second nozzle array. The connecting passage connects the first and second ink supply passages at first and second connecting portions, respectively. The first valve is provided in the first ink supply passage between the first ink cartridge and the first connecting portion, and the second valve is provided in the second ink supply passage between the second ink cartridge and the second connecting portion. The third valve is provided in the connecting passage. The valve controlling means control the first, second and third valves to change between a first state and a second state in a manner that both the first and second valves are open and the third valve is closed in the first state, and the third valve and either one of the first and second valves are open in the second state.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
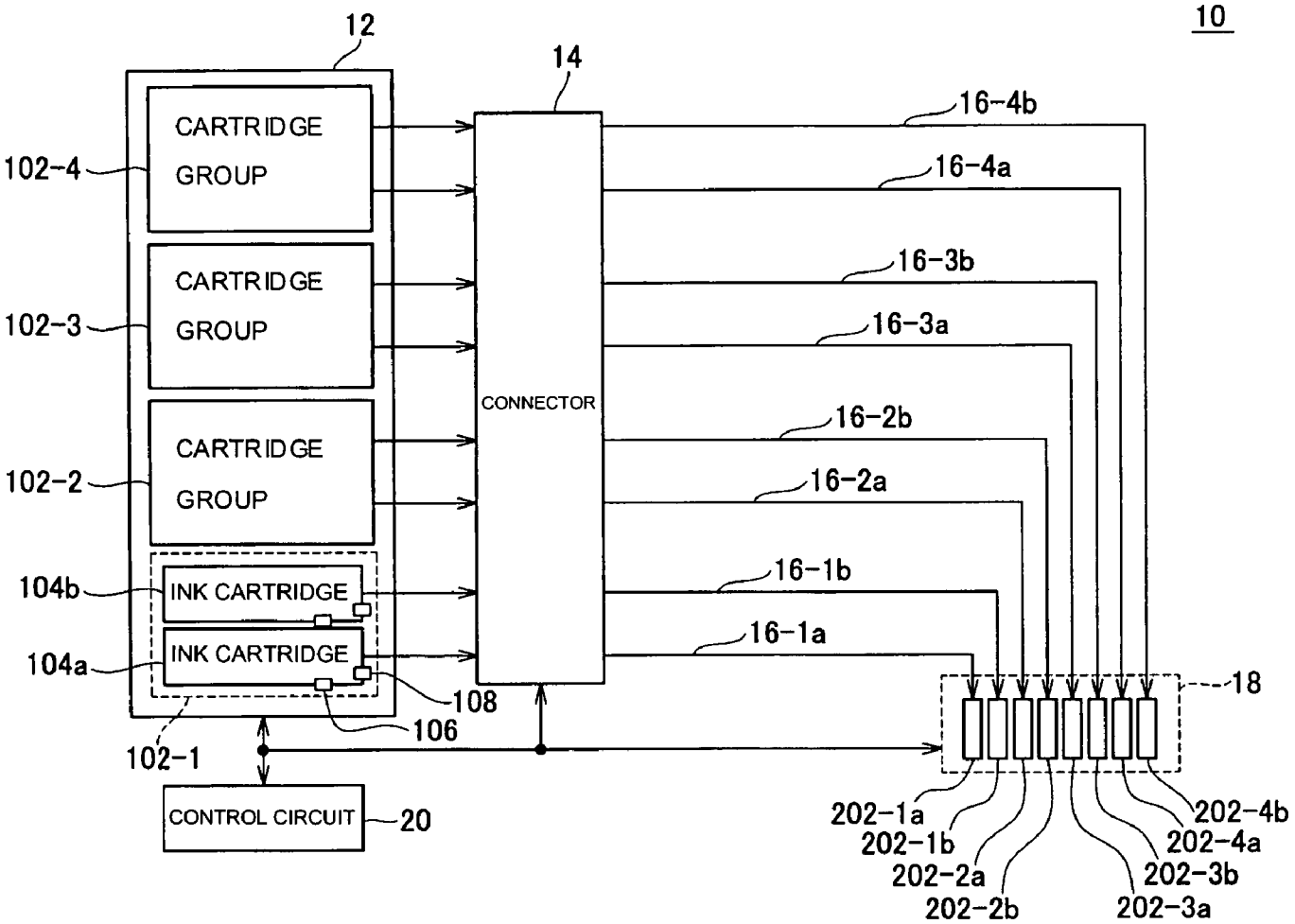
FIG. 1 is an illustration showing a structural example of a printer according to an embodiment of the present invention.

The embodiments will now be described with reference to the accompanying drawings, wherein like reference numerals designate corresponding or identical elements throughout the various drawings.

A printer according to an embodiment of the present invention is capable of changing the number of colors of inks to be used for printing. The printer is capable of changing the number of colors of inks used for printing means, for example, a printer capable of changing between eight color inks and four color inks. Embodiments of the present invention have the following arrangements.

(Arrangement 1) A printer which uses a plurality of ink cartridges to print includes a cartridge retainer for retaining first and second ink cartridges as the ink cartridges; first and second cartridge connecting valves connected to the first and second ink cartridges, respectively; a print head having first and second nozzle arrays corresponding to the first and second ink cartridges, respectively; a first ink supply passage which connects a first cartridge connecting valve (a first valve) to the first nozzle array so as to connect the first ink cartridge to the first nozzle array via the first cartridge connecting valve; a second ink supply passage which connects the second cartridge connecting valve to the second nozzle array so as to connect the second ink cartridge to the second nozzle array via a second cartridge connecting valve (a second valve); and a connecting passage provided to connect the first and second ink supply passages at first and second connecting portions, respectively. The first cartridge connecting valve is provided in the first ink supply passage between the first ink cartridge and the first connecting portion. The second cartridge connecting valve is provided in the second ink supply passage between the second ink cartridge and the second connecting portion. The printer further includes a connecting passage shut-off device for opening and closing of the connecting passage connecting the first ink supply passage and the second ink supply passage; and a valve control section (a valve controller) for controlling the opening or closing of the first and second cartridge connecting valves, and optionally of the connecting passage. In case of printing with the first and second ink cartridges containing different color inks, respectively, the connecting passage shut-off device is closed and the valve control section opens both the first and second cartridge connecting valves (a first state). In case of printing with the first and second ink cartridges containing the same color ink, the connecting passage shut-off device is opened and the valve control section opens one of the first and second cartridge connecting valves (a second state). The connecting passage shut-off device may be a valve (a third valve). Further, the ink cartridges containing different color inks mean ink cartridges which supply different color inks. The ink cartridges containing the same color ink mean ink cartridges which supply the same color ink.

In this arrangement, in case of printing with the first and second ink cartridges containing different color inks, the printing may be multi-color printing with the same number of colors as the number of the ink cartridges used. In case of printing with the first and second ink cartridges containing the same color ink, the number of nozzles for each color is twice as much as the case of multi-color printing with the same number of colors as the number of the ink cartridges. Therefore, in this case, the printing can be conducted at high speed as compared to the case of multi-color printing with the same number of colors as the number of the ink cartridges. The printing speed in this case may be generally doubled.

In case of printing with the first and second ink cartridges containing the same color ink, the two ink supply passages (the first and second ink supply passages) for the same color ink are connected so that the ink can be supplied to the two nozzle arrays from one of the ink cartridges. In this case, when one of the ink cartridges gets empty, the ink cartridge connected to the two ink supply passages can be automatically changed to the other ink cartridge Accordingly even when the ink cartridge is not replaced with new one before the start of printing, it can suitably prevent interruption of printing due to the ink end during image formation. Further, accordingly, the inks in the ink cartridges can be finished up without waste. Therefore, the switching between the ink cartridges can be suitably conducted while finishing up the remaining amount of ink without waste.

In this arrangement, the empty ink cartridge is cut off from the first and second ink supply passages. Therefore, the empty ink cartridge can be suitably replaced or refilled even during the image formation without interrupting the printing operation.

Furthermore, the cartridge retainer, the print head, the first and second ink supply passages are may be the same as the components used in a conventional printer, for example. The first and second cartridge connecting valves may be the same component used for the purpose of preventing ink spill or achieving uniform cleaning in a printer in which ink cartridges are arranged at a higher level than the nozzle surface or a printer in which a single pump is used to suck a plurality of nozzles, for example.

The embodiment of the present invention provides the printer which can suitably prevent interruption of printing due to the ink end, to be manufactured at a low cost.

In this arrangement, the first and second cartridge connecting valves are preferably automatic valves which open or close according to a command from the valve control section. The automatic valve means a valve which open or close according to a predetermined control without direct operation by a user, for example On the other hand, the connecting passage shut-off device may not be an automatic valve because it is enough to switch the connecting passage shut-off device before the start of printing according to the number of colors to be used. The connecting passage shut-off device may be a manual valve. Alternatively, the connecting passage shut-off device may be a connecting pipe arrangement in which communication between the first and second ink supply passages is allowed or interrupted by replacing the connecting pipe.

(Arrangement 2) In case of that the first and second ink cartridges contain the same color ink and one of the first and second cartridge connecting valves is opened, the valve control section closes the one cartridge connecting valve and opens the other cartridge connecting valve according to the emptying of the cartridge connecting to the one cartridge connecting valve. According to this arrangement, the ink cartridges can be suitably switched.

The valve control section, for example, preferentially opens the first cartridge connecting valve prior to the second cartridge connecting valve. Accordingly, the first ink cartridge is preferentially used. When the first cartridge gets empty, the valve control section closes the first cartridge connecting valve and opens the second cartridge connecting valve. Therefore, the second ink cartridge is used after the first ink cartridge gets empty.

(Arrangement 3) The cartridge retainer retains plural sets of the first and second ink cartridges, the printer includes plural sets each consisting of the first and second cartridge connecting valves, the first and second ink supply passages, and the connecting passage shut-off device, corresponding to the plural sets of the first and second ink cartridges retained by the cartridge retainer, and the print head has plural sets of the first and second nozzle arrays corresponding to the plural sets of the first and second ink cartridges.

According to this arrangement, a lot of color inks (for example, eight color inks) and a half number or less of color inks (for example, four color inks) can be selected suitably to be used. In case of using the half number or less of color inks (for example, four color inks), the switching between the ink cartridges can be suitably conducted while finishing up the remaining amount of ink without waste.

The cartridge retainer retains N sets of the first and second ink cartridges (N is any integer number equal to or more than 2, i.e. 2, 3, 4, . . . ), for example. In this case, the first and second ink cartridges in each of the N sets are ink cartridges containing ink of which color is different from the first and second ink cartridges of any other set. According to this arrangement, a 2N number of color inks and a N number of color inks can be selected suitably to be used. In case of using the N number or less of color inks, the switching between the ink cartridges can be suitably conducted while finishing up the remaining amount of ink without waste.

(Arrangement 4) The printer further includes a print control section (a print controller) for controlling the printing operation, wherein in case of printing with the first and second ink cartridges containing different color inks, respectively, the print control section stops the printing operation when either one of the first and second ink cartridges gets empty, and wherein in case of printing with the first and second ink cartridges containing the same color ink, the print control section does not stop the printing operation even when either one of the first and second ink cartridges gets empty and stops the printing operation when both the first and second ink cartridges get empty. According to this arrangement, the printing operation can be suitably controlled according to the number of color inks. Further, in case of printing with a less number of color inks, the switching between the ink cartridges can be suitably conducted. This type of printer may include a first ink sensor configured to detect that the first ink cartridge is empty, and a second ink sensor configured to detect that the second ink cartridge is empty. The printer may further include a print controller configured to control the print head, print controller stopping printing when either one of the first ink sensor or the second ink sensor detects that the ink cartridge is empty in the first state, print controller stopping printing when both of the first ink sensor and the second ink sensor detect that the ink cartridge is empty in the second state.

In case of printing with the first and second ink cartridges of the same color ink, when one of the ink cartridges gets empty, the print control section preferably notify a user of the empty of the ink cartridge while continuing the printing operation. In this manner, the empty ink cartridge can be suitably replaced or refilled.

The embodiments of the present invention can provide a printer at a low cost which can suitably prevent interruption of printing due to an ink end, for example.

Hereinafter, the embodiments according to the present invention will further be described with reference to the attached drawings. FIG. 1 shows an arrangement example of a printer 10 according to an embodiment of the present invention. The printer 10 is an inkjet printer which conducts multi-color printing with eight colors or four colors by changing the number of colors according to a command from a user and includes a cartridge retainer 12, a connector 14, a plurality of ink supply passages 16-1*a* through 16-4*b*, a print head 18, and a control circuit 20.

The cartridge retainer 12 retains a plurality of ink cartridges 104 used for printing. In this embodiment, the cartridge retainer 12 retains four cartridge groups 102-1 through 102-4 each having two ink cartridges 104*a* and 104*b*, thereby retaining eight ink cartridges 104 in total.

For multi-color printing with eight colors, the eight ink cartridges 104 retained by the cartridge retainer 12 contain different color inks, respectively, so that the cartridge retainer 12 retains eight ink cartridges 104 of different colors. On the other hand, for multi-color printing with four colors, the two ink cartridges 104*a*, 104*b* of each of the cartridge groups 102-1 through 102-4 retained by the cartridge retainer 12 contain same color ink so that the cartridge retainer 12 retains two ink cartridges 104*a*, 104*b* for each color.

The ink cartridge 104*a* of each cartridge group 102 is an example of a first ink cartridge. On the other hand, the ink cartridge 104*b* is an example of a second ink cartridge. The cartridge retainer 12 retains the respective ink cartridges 104*a*, 104*b* for every cartridge group 102 so that the cartridge retainer 12 retains the same number of pairs of the first and second ink cartridges as the number of the cartridge groups 102.

In this embodiment, each ink cartridge 104*a*, 104*b* is provided with an ink end sensor 106 and a cartridge detection sensor 108. The ink end sensor 106 is a sensor for detecting when the ink in the ink cartridge 104*a*, 104*b* is finished up (ink end). The cartridge detection sensor 108 is a sensor for detecting whether or not the ink cartridge 104*a*, 104*b* is retained by the cartridge retainer 12.

The connector 14 connects the ink cartridges 104*a*, 104*b* of the cartridge groups 102-1 through 102-4 to the eight ink supply passages 16-1*a* through 16-4*b*. The eight ink supply passages 16-1*a* through 16-4*b* supply inks supplied from the ink cartridges 104*a*, 104*b* to the print head 18 via the connector 14.

In this embodiment, the eight ink supply passages 16-1*a* through 16-4*b* are disposed corresponding to eight ink cartridges 104 retained by the cartridge retainer 12, respectively. For multi-color printing with eight colors, the ink supply passages 16-1*a* through 16-4*b* are connected via the connector 14 to the corresponding ink cartridges 104*a*, 104*b*, respectively. For multi-color printing with four colors, each pair of the ink supply passages 16-1*a* through 16-4*b* are connected via the connector 14 to either of the ink cartridges 104*a*, 104*b* in the cartridge group 102 for the corresponding ink cartridges 104*a*, 104*b*.

The print head 18 is an inkjet head for ejecting ink droplets. In this embodiment, the print head 18 has eight nozzle arrays 202-1*a* through 202-4*b* corresponding to the respective ink cartridges 104 retained by the cartridge retainer 12. The nozzle arrays 202-1*a* through 202-4*a* are examples of first nozzle arrays and correspond to the respective ink cartridges 104*a* of the cartridge groups 102-1 through 102-4. The nozzle arrays 202-1*b* through 202-4*b* are examples of second nozzle arrays and correspond to the respective ink cartridges 104*b* of the cartridge groups 102-1 through 102-4.

Each of the nozzle arrays 202-1*a* through 202-4*b* is a nozzle array including one or more nozzles which eject ink droplets according to a command of the control circuit 20. The nozzle arrays 202-1*a* through 202-4*b* are connected to the ink supply passages 16-1*a* through 16-4*b*, respectively. Therefore, inks are supplied to the nozzle arrays 202-1*a* through 202-4*b* from the ink cartridges 104 via the ink supply passages 16-1*a* through 16-4*b* and the connector 14.

The control circuit 20 controls the operation of the printer 10. In this embodiment, the control circuit 20 detects presence or absence of the respective ink cartridges 104*a*, 104*b* and an ink end according to the outputs from the cartridge detection sensors 108 and the ink end sensors 106 of the respective ink cartridges 104*a*, 104*b*. Then, according to the detection results, the control circuit 20 controls the operations of the connector 14 and the print head 18.

Figure 2:
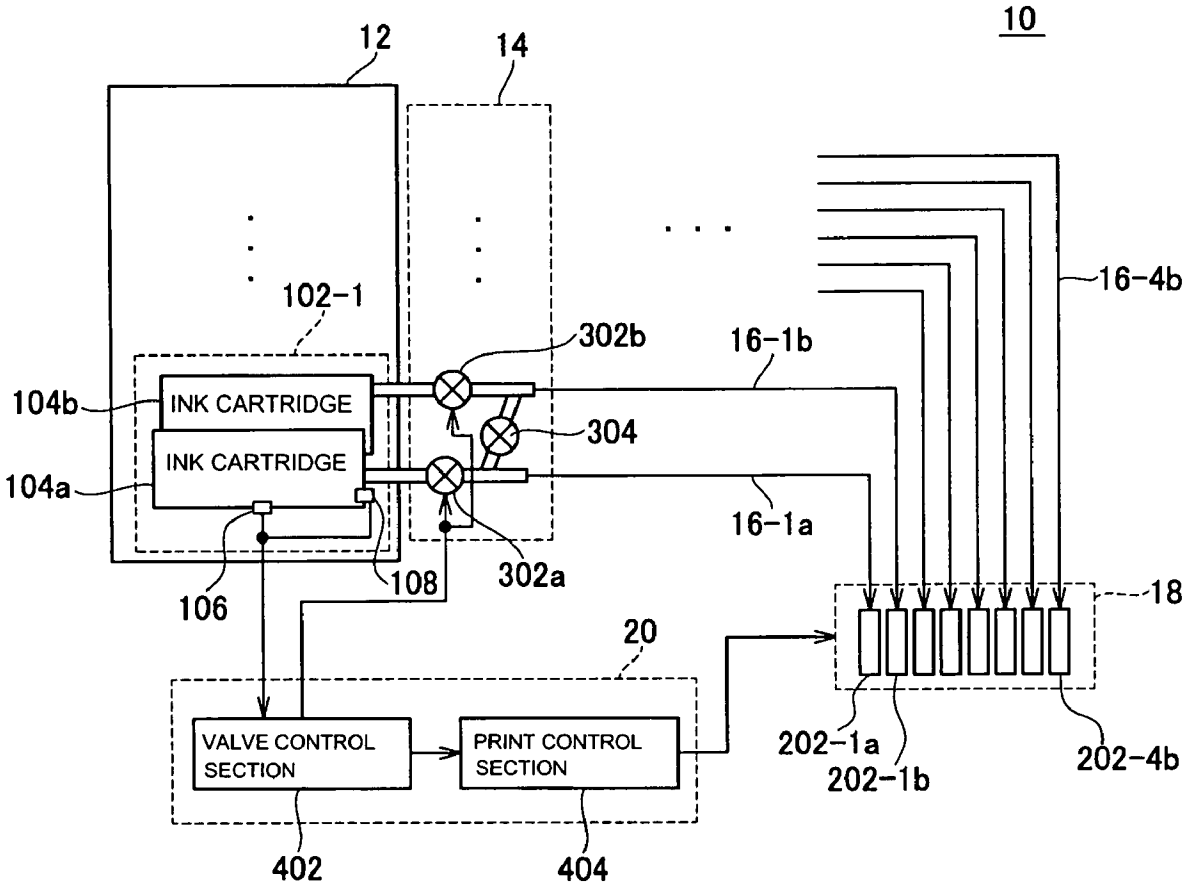
FIG. 2 is an illustration showing a detailed structural example of main parts of the printer.

FIG. 2 shows an example of the detailed structure of main parts of the printer 10. In this embodiment, the connector 14 has valves 302*a*, 302*b* and a valve 304 for each of the cartridge groups 102-1 through 102-4.

The valves 302*a*, 302*b* are automatic valves which open or close according to an output signal from a valve control section 402 in the control circuit 20. The valve 302*a* is an example of a first cartridge connecting valve and is connected to the ink cartridge 104*a* of the corresponding cartridge group 102. The valve 302*b* is an example of a second cartridge connecting valve and is connected to the ink cartridge 104*b* of the corresponding cartridge group 102.

The valves 302*a*, 302*b* are connected, at the sides opposite to the ink cartridges 104*a*, 104*b*, to the ink supply passages 16 corresponding to the ink cartridges 104*a*, 104*b*. For example, the valves 302*a*, 302*b* corresponding to the ink cartridges 104*a*, 104*b* of the cartridge group 102-1 are connected to the ink supply passages 16-1*a*, 16-1*b*, respectively.

Accordingly, the ink supply passages 16-1*a* through 16-4*b* connect the valves 302*a*, 302*b* corresponding to the respective cartridge groups 102-1 through 102-4 to the respective nozzle arrays 202-1*a* through 202-4*b*. For example, the ink supply passages 16-1*a*, 16-1*b* connect the valves 302*a*, 302*b* corresponding to the cartridge group 102-1 to the nozzle arrays 202-1*a*, 202-1*b*. Therefore, the ink cartridges 104*a*, 104*b* of the cartridge group 102-1 are connected to the nozzle arrays 202-1*a*, 202-1*b* via the valves 302*a*, 302*b*.

The valve 304 is an example of a connecting passage shut-off device for opening or closing a passage connecting the two ink supply passages 16 respectively connected to the valves 302*a*, 302*b* corresponding to the same cartridge group 102. For example, the valve 304 corresponding to the cartridge group 102-1 opens or closes a passage connecting the ink supply passage 16-1*a* and the ink supply passage 16-1*b*. It should be noted that, in this embodiment, the valve 304 is a manual valve. The valve 304 may be an automatic valve which is operated according to an output signal from the valve control section 402.

The control circuit 20 has the valve control section 402 and a print control section 404. The valve control section 402 controls the operation of the valves 302*a*, 302*b* corresponding to the respective cartridge groups 102-1 through 102-4. In this embodiment, the valve control section 402 detects presence or absence of the respective ink cartridges 104*a*, 104*b* and an ink end according to the outputs from the cartridge detection sensors 108 and the ink end sensors 106 of the respective ink cartridges 104*a*, 104*b*. According to the detection results, the valve control section 402 controls the operation of the respective valves 302*a*, 302*b*. Further, the valve control section 402 transmits the detection result of the ink end to the print control section 404.

The print control section 404 controls the printing operation of the printer 10 by controlling the operation and the like of the print head 18. Based on the detection result of the ink end received from the valve control section 402, the print control section 404 stops the printing operation when ink required for the printing is finished up.

Hereinafter, the operation of the printer 10 will be described in detail. First, description will be made as regard to the case of multi-color printing with eight colors. In this case, the cartridge retainer 12 retains the ink cartridges 104 of eight colors which are different colors from each other as described with regard to FIG. 1. Therefore, the ink cartridges 104*a*, 104*b* in each of the cartridge groups 102-1 through 102-4 contain different color inks.

The valves 304 are closed, for example, by a user before the start of printing. Therefore, the two ink supply passages 16 (for example, the ink supply passage 16-1*a* and the ink supply passage 16-1*b*) corresponding to the same cartridge group 102 become ink supply passages 16 independent from each other.

In this case, the valve control section 402 opens both the valves 302*a*, 302*b*. Therefore, inks of different colors are supplied to the ink supply passages 16-1*a* through 16-4*b*, respectively. The inks of different colors are further supplied to the nozzle arrays 202-1*a* through 202-4*b* connected to the ink supply passages 16-1*a* through 16-4*b*. Accordingly, the multi-color printing with eight colors of which number is equal to the total number of the ink cartridges 104*a*, 140*b* retained by the cartridge retainer 12 can be suitably conducted.

In this case, the print control section 404 stops the printing operation when any one of the ink cartridges 104*a*, 104*b* gets empty. Accordingly, the printing operation for the multi-color printing with eight colors can be suitably controlled.

Next, the description will be made with regard to a case of multi-color printing with four colors, the number of colors being a half of the number of colors in the above case. In this case, the cartridge retainer 12 retains the ink cartridges 104 of four colors, being different on a cartridge group 102 base. Therefore, the ink cartridges 104*a*, 104*b* in each of the cartridge groups 102-1 through 102-4 contain same color ink.

The valves 304 are opened, for example, by the user before the start of printing. The valve control section 402 opens either one of the valves 302*a*, 302*b* corresponding to the same cartridge group 102. Supplied to the two ink supply passages 16 (for example, the ink supply passages 16-1*a*, 16-1*b*) corresponding to the same cartridge group 102 is thus the ink from the ink cartridge 104 connected to the opened one of the valves 302*a*, 302*b*. Accordingly, the two ink supply passages 16 corresponding to the same cartridge group 102 become ink supply passages 16 for the same color ink. Therefore, supplied to the two nozzle arrays 202 (for example, the nozzle arrays 202-1*a*, 202-1*b*) connected to the two ink supply passages 16 is also the same color ink. In this case, the number of nozzles for each color is twice as much as the case of multi-color printing with eight colors. Therefore, in this case, the printing can be conducted at high speed as compared to the case of multi-color printing with eight colors.

In case of multi-color printing with four colors, the valve control section 402 controls the switching between the ink cartridges 104*a*, 104*b* to be used. For example, when the valve control section 402 opens the valve 302*a* first of the valves 302*a*, 302*b*, the valve control section 402 closes the valve 302*a* and opens the valve 302*b* according to the emptying of the ink cartridge 104*a* connected to the valve 302*a*. In this manner, in case that one of the ink cartridges 104*a* gets empty, the ink cartridge 104 connected to the two ink supply passages 16 can be automatically changed to the other ink cartridge 104*b*.

According to this embodiment, it can suitably prevent interruption of printing due to the ink end during image formation. Therefore, occurrence of printing error can be prevented and noncompletion of the image formation in a scheduled time can be prevented. Further, in this case, the inks in the respective ink cartridges 104*a*, 104*b* can be finished up without waste. According to this embodiment, the switching between the ink cartridges 104*a*, 104*b* can be suitably conducted while finishing up the remaining amount of ink without waste.

Further, the arrangement of this embodiment can be achieved, for example, from a conventional printer without significant changes. That is, the function for switching the ink cartridges 104*a*, 104*b* can be achieved with just a little increase of cost. Furthermore, it also enables the printer 10, which can suitably prevent interruption of printing due to the ink end, to be manufactured at a low cost.

According to the embodiment of the present invention, in case of multi-color printing with four colors, the print control section 404 does not stop the printing operation when only one of the two ink cartridges 104*a*, 104*b* in the same cartridge group 102 gets empty and stops the printing operation when both the two ink cartridges 104*a*, 104*b* get empty. In this manner, the print control section 404 can suitably control the printing operation according to the number of colors of inks. Further, in case of multi-color printing with four colors, the switching between the ink cartridges 104*a*, 104*b* can be suitably conducted.

The printer 10 is preferably provided with a display for displaying the state of ink end of the selected ink cartridge 104 or the states of ink end of the respective ink cartridges 104. The selected ink cartridge 104 means the ink cartridge 104 of which the corresponding valve 302*a* or 302*b* is opened. The display may be an LED display. Further, the display may be disposed on each ink cartridge 104.

According to this arrangement, it can suitably display which ink cartridge 104 is in use and display the ink end of each ink cartridge 104. This assists the user to suitably replace or refill the ink cartridge 104.

In case of multi-color printing with four colors, when one of the two ink cartridges 104*a*, 104*b* in the same cartridge group 102 gets empty, the print control section 404 preferably notify the user of the empty of the ink cartridge 104 while continuing the printing operation. This notification may be conducted by the aforementioned display. In this manner, the ink cartridge 104 can be suitably replaced or refilled even during the image formation without interrupting the printing operation.

In case of multi-color printing with four colors, when some of the ink cartridges 104 in any and all cartridge groups 102 are not mounted, the printer 10 can print with only ink cartridges 104*a*, 104*b* which are attached. In this case, the print control section 404 and the valve control section 402 treat the ink cartridge 104, which is not attached, the same as the empty ink cartridge 104, for example, to conduct the respective controls.

It should be noted that the ratio of the maximum quantity of printable colors to the quantity of limited colors in the printer 10 is not limited to twice and may be more than twice. In this case, for example, at least some cartridge groups 102 each have three or more ink cartridges 104. Also in this case, the ink cartridges 104 in the same cartridge group 102 may contain different color inks or same color ink according to the number of colors for multi-color printing. For printing with limited number of colors, the ink cartridges 104 in the same cartridge group 102 are switched to be sequentially used.

Though the present invention has been described with regard to the embodiment, the technical scope of the present invention is not limited to the scope described in the aforementioned embodiment. It will be apparent to those skilled in the art that various modifications and improvements can be applied to the aforementioned embodiment. It is apparent from the claims of the present invention that embodiments with such modifications and improvements are within the technical scope of the present invention.

A printer according to the embodiment of the present invention can be suitably used in a printer, for example.

What is claimed as new and is desired to be secured by Letters Patent of the United States is:

1. A printer comprising:

first and second ink cartridges;

a print head having first and second nozzle arrays;

a first ink supply passage connecting the first ink cartridge to the first nozzle array;

a second ink supply passage connecting the second ink cartridge to the second nozzle array;

a connecting passage connecting the first and second ink supply passages at first and second connecting portions, respectively;

a first valve provided in the first ink supply passage between the first ink cartridge and the first connecting portion;

a second valve provided in the second ink supply passage between the second ink cartridge and the second connecting portion; and a third valve provided in the connecting passage, both the first and second valves being open and the third valve being closed in a first state, the third valve and either one of the first and second valves being open in a second state.

2. The printer according to claim 1, further comprising:

an ink sensor configured to detect that the first ink cartridge is empty, the first valve being closed and the second valve being opened in the second state when the ink sensor detects that the first ink cartridge is empty.

3. The printer according to claim 1, further comprising:

a first ink sensor configured to detect that the first ink cartridge is empty;

a second ink sensor configured to detect that the second ink cartridge is empty; and a print controller configured to control the print head, print controller stopping printing when either one of the first ink sensor or the second ink sensor detects that the ink cartridge is empty in the first state, print controller stopping printing when both of the first ink sensor and the second ink sensor detect that the ink cartridge is empty in the second state.

4. The printer according to claim 1, further comprising:

a valve controller configured to control the first, second and third valves to change between the first state and the second state.

5. The printer according to claim 1, further comprising:

a cartridge retainer retaining the first and second ink cartridges.

6. The printer according to claim 1, wherein the first ink cartridge contains first ink having a first ink color, the second ink cartridge contains second ink having a second ink color, and the first ink color is different from the second ink color in the first state.

7. The printer according to claim 1, wherein the first ink cartridge contains first ink having a first ink color, the second ink cartridge contains second ink having a second ink color, and the first ink color is same as the second ink color in the second state.

8. A method for printing comprising:

connecting a first ink cartridge to a first nozzle array of a printing head via a first ink supply passage;

connecting a second ink cartridge to a second nozzle array of a printing head via a second ink supply passage;

connecting the first and second ink supply passages via a connecting passage at first and second connecting portions, respectively;

providing a first valve in the first ink supply passage between the first ink cartridge and the first connecting portion;

providing a second valve in the second ink supply passage between the second ink cartridge and the second connecting portion;

providing a third valve in the connecting passage;

opening both the first and second valves and closing the third valve in a first state; and opening the third valve and either one of the first and second valves in a second state.

9. A printer comprising:

first and second ink cartridges;

a print head having first and second nozzle arrays;

a first ink supply passage connecting the first ink cartridge to the first nozzle array;

a second ink supply passage connecting the second ink cartridge to the second nozzle array;

a connecting passage connecting the first and second ink supply passages at first and second connecting portions, respectively;

a first valve provided in the first ink supply passage between the first ink cartridge and the first connecting portion;

a second valve provided in the second ink supply passage between the second ink cartridge and the second connecting portion;

a third valve provided in the connecting passage; and a valve controller configured to control the first, second and third valves to change between a first state and a second state, both the first and second valves being open and the third valve being closed in the first state, the third valve and either one of the first and second valves being open in the second state.

10. A printer comprising:

first and second ink cartridges;

a print head having first and second nozzle arrays;

a first ink supply passage connecting the first ink cartridge to the first nozzle array;

a second ink supply passage connecting the second ink cartridge to the second nozzle array;

a connecting passage connecting the first and second ink supply passages at first and second connecting portions, respectively;

a first valve provided in the first ink supply passage between the first ink cartridge and the first connecting portion;

a second valve provided in the second ink supply passage between the second ink cartridge and the second connecting portion;

a third valve provided in the connecting passage; and valve controlling means for controlling the first, second and third valves to change between a first state and a second state, both the first and second valves being open and the third valve being closed in the first state, the third valve and either one of the first and second valves being open in the second state.

* * * * *